US007758003B2

(12) United States Patent
Pourtier et al.

(10) Patent No.: US 7,758,003 B2
(45) Date of Patent: Jul. 20, 2010

(54) SUSPENSION PLATE FOR FIXING TO CEILING

(75) Inventors: Fabrice Pourtier, Portes les Valence (FR); Christian Ricordi, Bourg les Valence (FR)

(73) Assignee: Societe de Prospection et d'Inventions Techniques Spit (FR)

( * ) Notice: Subject to any disclaimer, the term of this patent is extended or adjusted under 35 U.S.C. 154(b) by 697 days.

(21) Appl. No.: 11/568,973

(22) PCT Filed: May 9, 2005

(86) PCT No.: PCT/IB2005/001262

§ 371 (c)(1),
(2), (4) Date: Nov. 10, 2006

(87) PCT Pub. No.: WO2005/111334

PCT Pub. Date: Nov. 24, 2005

(65) Prior Publication Data

US 2007/0210230 A1 Sep. 13, 2007

(30) Foreign Application Priority Data

May 12, 2004 (FR) ..... 04 05139

(51) Int. Cl.
*A47F 5/00* (2006.01)

(52) U.S. Cl. ..... 248/300; 248/317; 248/475.1

(58) Field of Classification Search ..... 248/317, 248/475.1, 300, 301, 327, 328; 52/506.05, 52/506.06, 506.08
See application file for complete search history.

(56) References Cited

U.S. PATENT DOCUMENTS

| | | | | |
|---|---|---|---|---|
| 3,055,625 | A | 9/1962 | Kopf et al. | |
| 3,612,461 | A * | 10/1971 | Brown | 248/317 |
| 3,778,942 | A * | 12/1973 | Bondi | 52/134 |
| 5,667,181 | A * | 9/1997 | van Leeuwen et al. | 248/343 |
| 6,763,691 | B1 * | 7/2004 | Rafferty | 70/164 |
| 2003/0222190 | A1 | 12/2003 | Masas | |

FOREIGN PATENT DOCUMENTS

| | | | |
|---|---|---|---|
| AU | 611305 | B | 6/1991 |
| CH | 514755 | A | 10/1971 |
| CH | 676728 | A5 | 2/1991 |
| DE | 20304313 | U1 | 6/2003 |
| FR | 2252773 | A | 6/1975 |
| GB | 2351319 | A | 12/2000 |
| WO | 9828505 | A1 | 7/1998 |

* cited by examiner

*Primary Examiner*—Amy J Sterling
(74) *Attorney, Agent, or Firm*—Lowe Hauptman Ham & Berner, LLP

(57) ABSTRACT

The suspension plate is divided into a plurality of adjacent functional portions (2, 13, 24), including a fixing portion (2), the said portions each being separated from another by a bending zone (10, 15) to be folded back in pairs one towards the other. One of the bending zones (10) is weakened by at least one notch (11, 12) for reception of a flexible strand (25). The invention is applied, in particular, to the suspension of false ceilings.

14 Claims, 2 Drawing Sheets

SUSPENSION PLATE FOR FIXING TO CEILING

RELATED APPLICATIONS

Figure 1:
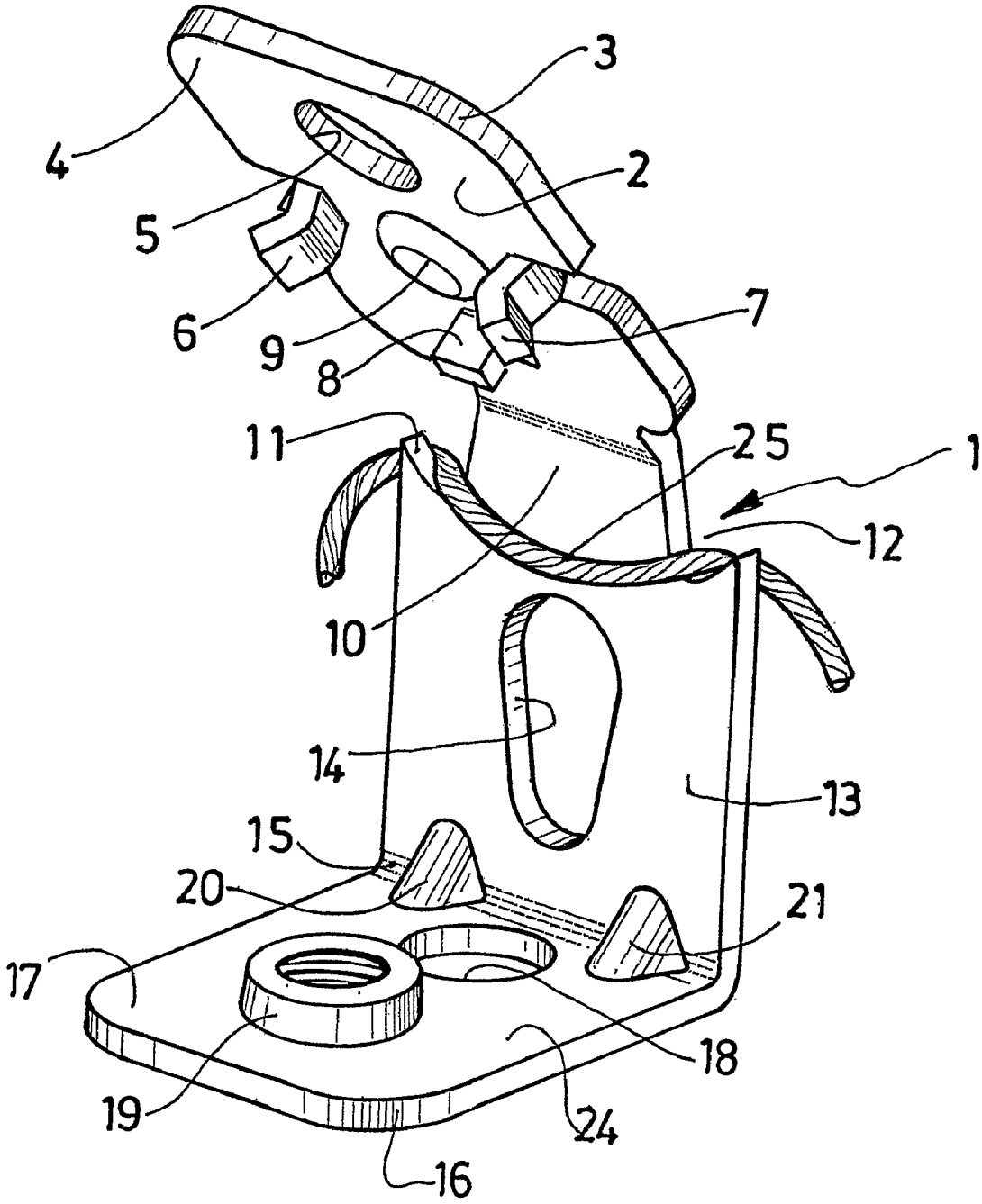

The present application is a National Phase entry of International Application Number PCT/IB2005/001262, filed May 9, 2005, which claims priority from, French Application Number 0405139, filed May 12, 2004, the disclosures of which are hereby incorporated by reference herein in their entirety.

The invention relates to suspension plates for fixing to the ceiling of a room and to which can be fixed or from which can be suspended in particular hooks or rods, threaded or otherwise, and which will in turn serve as organs for suspension of another piece.

The devices to which this relates can be made from a flat sheet-metal blank, cut-out and stamped, and divided into a plurality of functional parts separated by bending zones, a first part forming a fixing part, another part being able to be a part for reception of a threaded rod or a bolt, and yet another part a part for reception of a hook, etc.

Such a device is installed by firstly fixing the fixing part of the suspension blank, then bending the blank so that the part adjacent to the fixed part is folded back and, often, comes substantially at right-angles to the fixed part and so on, from blank part to adjacent blank part.

The suspension plates are generally fixed to the ceiling by means of a fixing apparatus of the gas, powder, or pneumatic nailer type or other manually operated fixing tool.

The bending (at right-angles) of the various parts of a suspension blank, in pairs, along predetermined bending zones determines its correct functioning. Now, the suspension devices of the prior art give no fully satisfactory guarantee in this respect. Moreover, the devices of the prior art on not always of a sufficiently universal nature to allow fixing or hooking to them or suspension from them under easy conditions of use, of all the organs used by the different trades encountered on building or public works sites.

The present application is intended to meet these requirements.

Thus, the invention relates to a suspension plate to be fixed to a ceiling, divided into a plurality of adjacent functional portions, including a fixing portion, the said portions being separated each from another by a bending zone to be folded one towards the other in pairs, characterised by the fact that one of the bending zones is weakened by at least one notch for reception of a flexible strand of a suspension element.

Flexible strand of a suspension element means principally a strand of a cable loop or other suspension wire for example for suspension of a false ceiling.

Naturally, two notches will be formed a priori at the two transversal ends of the bending zone.

The invention is notable by the dual function of the notches, which are used not only to receive a cable or other similar element, but also to weaken the bending zone in question thus notched and therefore shortened, with the advantageous result of ensuring that folding of one of the two portions separated by this notched bending zone towards the other, will indeed take place along this bending zone and not to the side, for example along another weakness such as a hole for reception of a hook.

In the preferred embodiment of the suspension plate of the invention, the notched bending zone separates the fixing portion from an adjacent portion.

Figure 2:
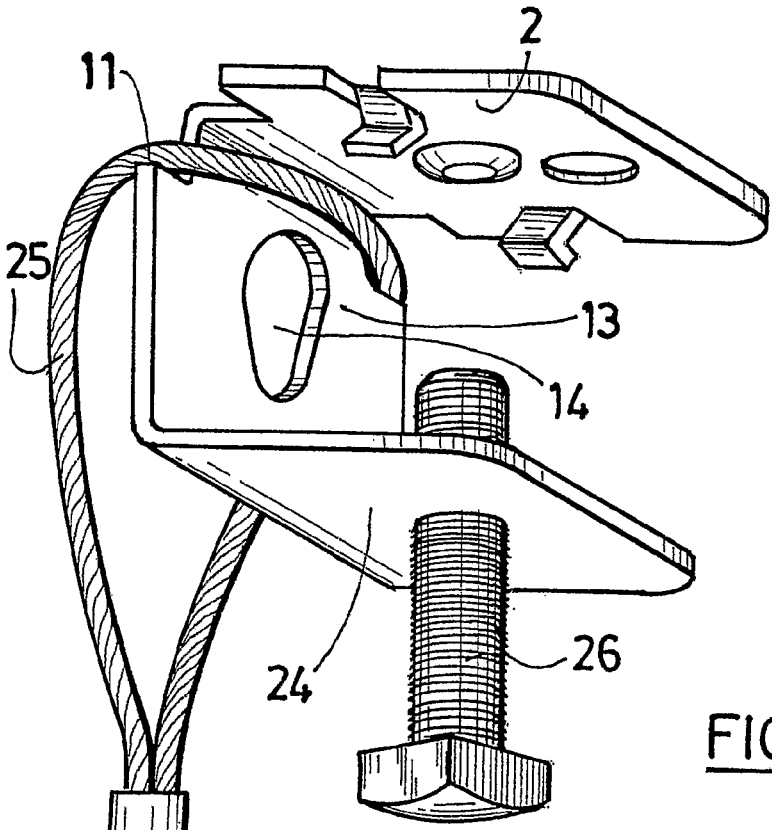
Figure 3:
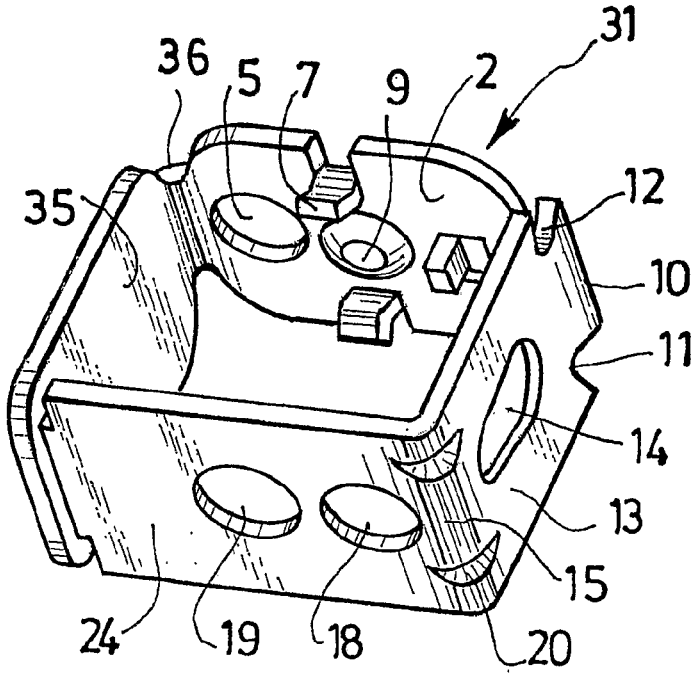

The invention will be better understood with the aid of the following description of several embodiments of the suspension plate of the invention, with reference to the attached drawings, in which FIG. 1 is a perspective view of a plate with three portions with the portions more or less folded the ones towards the others;

FIG. 2 is a side view slightly in perspective of the plate of FIG. 1, after folding back of the portions the ones relative to the others, with a suspended cable and a bolt fixed to the plate and FIG. 3 is a perspective view of a plate with four portions completely folded back the ones relative to the others.

The suspension device which will now be described with reference to FIG. 1 is here a rectangular plate 1 cut out of a sheet-metal blank and formed of three parts, each cut out and stamped as described hereinafter.

A first part 2 has firstly been cut out to form free rounded corners 3, 4 and an orifice 5 for passage of a fixing bolt and to free, before stamping, two lateral tabs 6, 7 for centering and attachment to the nose (point-guide) of the tool with which the plate will be fixed to the ceiling, and a stop 8 and boss 9 also for fixing by the tool. Then this plate part 2 has been stamped to form the tabs 6, 7 and the stop 8 and a boss 9 for reception of a fixing plug.

A second part 13, adjacent to the fixing part 2, has also been cut out to present, in the junction zone 10 of the two parts 2, 13, two lateral notches 11, 12, this zone 10 thus being shortened and therefore weakened. An oblong opening 14 has also been cut out at the centre of this plate part 13, to receive the hook of a suspension rod, for example.

Lastly, the plate includes a third part 24, adjacent to the part 13 along a zone 15. This plate part 24 has been cut out to provide rounded free corners 16, 17 and an orifice 18 for passage of a suspension rod, for example. This plate part 24 has also been stamped to create a small passage 19 which has then been tapped to receive a threaded rod. Stop reinforcements 20, 21 have been stamped in the zone 15.

The junction zones 10, 15 of the plate parts in pairs are bending zones for folding back each of the plate parts towards another.

In the example in question, the second and third parts 13, 24 of the original plate are already bent and folded back one towards the other at right-angles.

The use of the suspension plate will now be described.

The fixing part 2 is fixed to the ceiling of a room, either by a plug fixed through the boss 9 or by means of a pin anchored in the ceiling through the hole 5 and a fixing organ of screw type. This fixing is advantageously performed using a conventional fixing tool, the nose of which is slid between the tabs 6, 7 in the case of fixing with a plug.

After fixing of this plate part 2 to the ceiling against which it is therefore pressed flat, by means of a simple tool, of the screwdriver type, or even with the hand, the remainder of the plate is moved away, folding back the plate part 13, here at right-angles to the part 2. This folding back occurs naturally about the bending zone 10 weakened by the notches and not, for example, about a zone passing through the orifice 14. The folding back of this part 13 occurs correctly, and it can come to exactly 90° to the part 2.

The fact that the folding back has been correctly effected means that the third part of the plate 24 is quite parallel with the second part 2 and therefore with the ceiling.

The suspension device 1 being fixed and conformed in the use position, it is possible either to pass a cable loop 25 around the zone 10 of junction of the two plate parts 2, 13, in the notches 11, 12, or to introduce a hooked rod into the holes 18, 14, or to screw a bolt 26 or a threaded rod into the tapped orifice 19 of the plate part 24.

The second embodiment 31 of the suspension plate of the invention shown in FIG. 3 includes no longer three, but four parts intended to form a sleeve of rectangular section. It is only distinguished by the fourth part 35 only intended to strengthen the suspension device and to firmly attach the first and third plate parts and to ensure perfect 90° folds. The means of FIG. 3 identical to those of FIG. 1 carry the same reference marks. The two plate parts 2 and 35 are joined together by a bending zone 36.

The invention claimed is:

1. Suspension plate for fixing to a ceiling, the suspension plate comprising three adjacent functional portions, including a fixing portion, a bolt supporting portion in which a tapped bore is formed to threadedly receive a bolt, and a notched portion in which a pair of notches are formed on either side of a junction zone, the three adjacent functional portions each being separated from another by a bending zone so as to be foldable towards an adjacent portion, one of the bending zones being narrowed by the pair of notches and configured for reception of a flexible strand in a manner wherein the flexible strand passes over each of the notches and about the bending zone narrowed by the pair or notches, the suspension plate further comprising a boss formed on the fixing portion and positioned so that when the bolt supporting portion is bent into a predetermined configuration, the bolt in the tapped bore extends directly toward the boss on the fixing portion.

2. Suspension plate as described in claim 1, in which a weakened and notched bending zone includes two notches at its two transversal ends.

3. Plate as described in claim 1, in which a weakened and notched bending zone separates the fixing portion from an adjacent portion.

4. Plate as described in claim 1, in which at least three portions are provided.

5. Plate as described in claim 4, in which four portions are provided, arranged to form a sleeve of rectangular section.

6. Plate as described in claim 1, in which a part is provided for reception of a threaded member.

7. Suspension plate as described in claim 1, wherein each of the notches is formed so as to be essentially a mirror image of the other.

8. Suspension plate as described in claim 1, wherein the fixing portion comprises a boss configured to be engaged by the bolt.

9. Suspension plate as described in claim 1, wherein the notched portion interconnects the fixing portion with the bolt supporting portion.

10. Suspension plate as described in claim 1, wherein the notched portion is formed with an oblong opening configured to receive a hooked rod, the orifice being formed in a portion of the notched portion separate from the junction zone.

11. Suspension plate as described in claim 1, wherein the fixing portion comprises a pair of tabs which are each bent at an angle with respect to the fixing portion.

12. Suspension plate as described in claim 1, wherein when bent into the predetermined configuration the bolt supporting portion extends essentially parallel with the fixing portion.

13. Suspension plate for fixing to a ceiling, the suspension plate comprising:

three adjacent functional portions, including:

a fixing portion, a bolt supporting portion in which a tapped bore is formed to threadedly receive a bolt, and a notched portion in which a pair of notches are formed on either side of a junction zone, the three adjacent functional portions each being separated from another by a bending zone so as to be foldable towards an adjacent portion, one of the bending zones being narrowed by the pair of notches, and a flexible strand which passes over each of the notches and about the bending zone narrowed by the pair or notches.

14. Suspension plate as described in claim 13, wherein the flexible strand is configured to support a load when the suspension plate is clamped to a ceiling feature.

* * * * *